United States Patent [19]

Fisher et al.

[11] Patent Number: 4,510,614

[45] Date of Patent: Apr. 9, 1985

[54] PREDISTORTED AM STEREO TRANSMISSION

[76] Inventors: Charles B. Fisher, 2850 Hill Park Rd., Montreal, Quebec H3H 1T1; Sidney T. Fisher, 53 Morrison Ave., Montreal, Quebec H3R 1K3, both of Canada

[21] Appl. No.: 577,686

[22] Filed: Feb. 7, 1984

[51] Int. Cl.[3] ..... H04H 5/00

[52] U.S. Cl. ..... 381/16

[58] Field of Search ..... 381/15, 16; 332/37 R, 332/37 D, 40, 41, 44; 455/126

[56] References Cited

U.S. PATENT DOCUMENTS 4,332,978 6/1982 Streeter ..... 381/16

4,401,853 8/1983 Fisher et al. ..... 381/15

OTHER PUBLICATIONS

D. Mennie, "AM Stereo, Five Competing Options", *IEEE Spectrum,* Jun. 1978, pp. 24–31.

Reference Data for Radio Engineers, 5th edition, ITT pp. 15–1 to 15–4.

*Primary Examiner*—Gene Z. Rubinson

*Assistant Examiner*—W. J. Brady

[57] ABSTRACT

A method for generating a compatible AM quadrature stereo wave by delivering a modulated carrier with in-phase sidebands generated by a first combination of two signals, and quadrature sidebands generated by a second combination of the signals, the in-phase and quadrature sidebands having substantially the same maximum amplitude. The carrier and both sets of sidebands are delivered to an envelope detector, which delivers only the first combination of signals, undistorted by the presence of the quadrature sidebands. The carrier and both sets of sidebands are also delivered to a synchronous detector, which delivers only the first combination of signals with predistortion. The output of the synchronous detector is subtracted from the output of the envelope detector to obtain as a result the predistortion of the first signal combination due to the presence of the quadrature sidebands. The distortion is then passed through a filter with the pass-band of the signal frequency band, and an equalizer, which adjusts delay so that negative feedback occurs across a wide frequency band, in accordance with well-known theory. The output of the equalizer is delivered to the modulator for the first combination of signals, so that the transmitter delivers carrier, in-band predistorted sidebands, and quadrature sidebands, which are demodulated by the envelope detector of a receiver as the first combination of signals, free from distortion.

1 Claim, 1 Drawing Figure

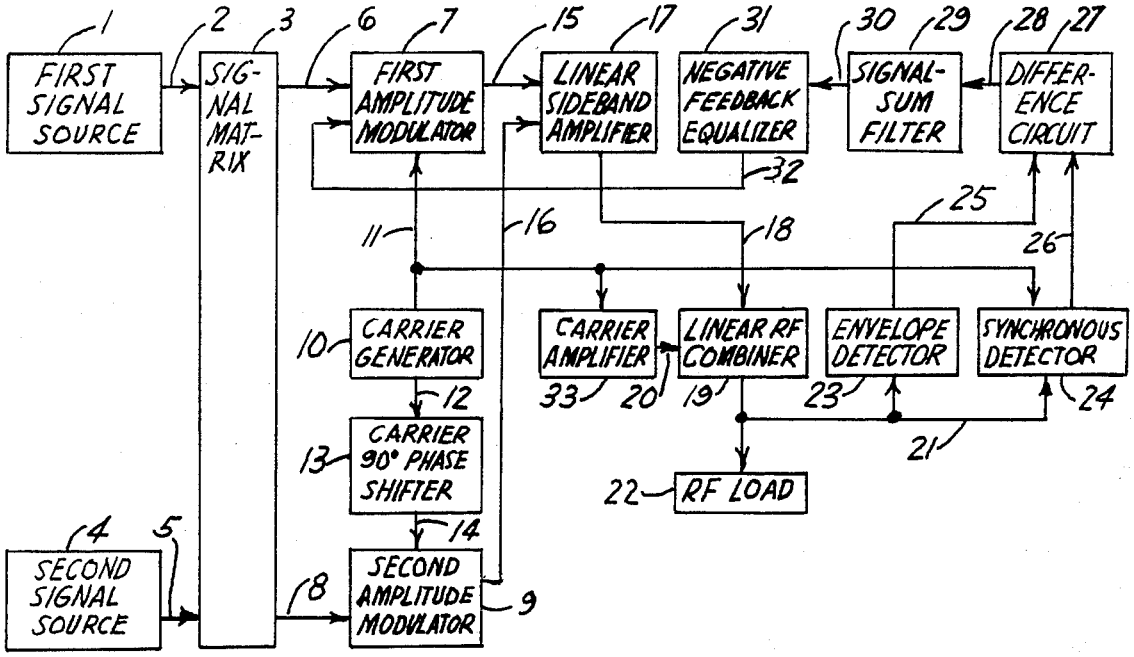
FIRST SIGNAL SOURCE
SIG-NAL MAT-RIX
FIRST AMPLITUDE MODULATOR
LINEAR SIDEBAND AMPLIFIER
NEGATIVE FEEDBACK EQUALIZER
SIGNAL-SUM FILTER
DIFFER-ENCE CIRCUIT
CARRIER GENERATOR
CARRIER AMPLIFIER
LINEAR RF COMBINER
ENVELOPE DETECTOR
SYNCHRONOUS DETECTOR
CARRIER 90° PHASE SHIFTER
RF LOAD
SECOND SIGNAL SOURCE
SECOND AMPLITUDE MODULATOR
1
2
3
4
5
6
7
8
9
10
11
12
13
14
15
16
17
18
19
20
21
22
23
24
25
26
27
28
29
30
31
32
33

PREDISTORTED AM STEREO TRANSMISSION

BACKGROUND OF THE INVENTION

A method is disclosed for compatible AM stereo transmission, with predistorted in-phase sidebands, so that the predistortion cancels the distortion generated by the envelope detector of a receiver due to the presence of quadrature sidebands.

There are a number of prior-art compatible AM stereo transmitters, transmitting the signal sum in part by in-phase sidebands, and the signal difference in part by quadrature sidebands. These systems have material distortion of the signal sum at the output of an envelope detector, due to the presence of quadrature sidebands. In these systems the power available for the sidebands of each type is not equal.

In the invention, the carrier with predistorted in-phase and quadrature sidebands is delivered at the transmitter to an envelope detector, which delivers a signal combination, say the sum, without distortion due to the quadrature sidebands, and is also delivered to a synchronous detector, which delivers the signal sum with predistortion. The difference of the detector outputs, which is the predistortion, is returned to the input of the signal-sum modulator as negative feedback. The transmitter then emits a wave with the signal-sum sidebands predistorted, and undistorted signal-difference sidebands. At an envelope detector of a receiver, the signal-sum predistortion is substantially cancelled by the detector distortion due to the presence of quadrature sidebands. This transmitter is stable, due to the negative feedback, has equal power available in each channel, and causes no material distortion of the signal in an envelope detector. It has therefore substantial utility over prior-art transmitters. It uses well-known circuit elements and is based on well-known theory.

SUMMARY OF THE INVENTION

The invention is a method for compatible AM stereo transmission, using a carrier with predistorted in-phase amplitude-modulation sidebands produced by the sum of the signals, and quadrature amplitude-modulation sidebands produced by the difference of the signals. A wave comprising the carrier, the predistorted in-phase sidebands, and the quadrature sidebands, is delivered to an envelope detector, which has an output of the signal sum, distorted by the predistorted sidebands, and equally in opposite phase by the presence of the quadrature sidebands. The wave is also delivered to a synchronous detector, which has an output of the predistorted signal sum. The output of the synchronous detector is subtracted from the output of the envelope detector, to obtain the distortion of the signal sum due to the presence of quadrature sidebands at the envelope detector. This distortion is restricted to the signal frequency band, and is equalized in delay and frequency response according to negative-feedback theory, and is returned to the input of the in-phase sideband modulator as negative feedback. As a result the transmitter produces a wave comprising the carrier, the predistorted in-phase sidebands, and the quadrature sidebands, with the frequency band of the carrier amplitude-modulated by the signal sum. At the envelope detector of a mono or stereo receiver, the distortion of the signal sum caused by the presence of the quadrature sidebands substantially cancels the predistortion of the signal-sum sidebands, and the envelope detector of the receiver delivers the signal sum substantially free from distortion, as in the envelope detector in the transmitter.

Additional features of the prior art, such as pilots and noise-reduction circuits, may be used with the transmitter, including alternative methods of producing in-phase and quadrature sidebands on a carrier. Receivers of the prior art, such as those shown in U.S. Pat. No. 4,401,853, may be used. No prior-art transmitter has been found with predistortion of the in-phase sidebands by the use of two different types of detectors which cancels receiver envelope distortion.

BRIEF DESCRIPTION OF THE DRAWING

The drawing shows a simplified block schematic circuit which operates according to the invention.

DETAILED DESCRIPTION OF THE ILLUSTRATED EMBODIMENT

The drawing shows a simplified block schematic circuit diagram of apparatus which operates with the method of the invention. Since the signals do not have specified polarities, the signal sum is assumed to generate the in-phase sidebands, without loss of generality.

A first signal from source 1 is delivered over lead 2 to a first input of signal matrix 3. A second signal from source 4 is delivered over lead 5 to signal matrix 3. The sum of the first and second signals is delivered over lead 6 to signal-sum amplitude modulator 7. The difference of the first and second signals is delivered as output over lead 8 from signal matrix 3 to signal-difference amplitude modulator 9. Carrier generator 10 supplies carrier to signal-sum modulator 7 over lead 11, to carrier amplifier 33 and synchronous detector 24 over lead 11, and to 90° carrier phase shifter 13 over lead 12. Carrier phase shifter 13 supplies carrier over lead 14 to signal-difference amplitude modulator 9. Thus signal-sum modulator 7 generates in-phase sidebands with carrier suppressed, and signal-difference modulator 9 generates quadrature sidebands with carrier suppressed. Carrier amplifier 33 may be non-linear. Modulator 7 delivers in-phase sidebands over lead 15 to linear sideband amplifier 17, which also receives quadrature sidebands from modulator 9 on lead 16, and delivers its output to linear RF combiner 19 over lead 18. Carrier amplifier 33 delivers carrier over lead 20 to combiner 19, which delivers its output over lead 21 to RF load 22, envelope detector 23 and synchronous detector 24. When the in-phase sidebands and the quadrature sidebands on lead 21 have the same frequencies and the same amplitude, envelope detector 23 output on lead 25 to difference circuit 27 has the same frequency and fundamental amplitude as the output of detector 24 on lead 26 to 27.

The output of detector 23 is signal sum, plus predistortion, less equal distortion due to quadrature sidebands on lead 21. The output of synchronous detector 24 is the predistorted signal sum. The output of difference circuit 27 on lead 28 to signal filter 29 is the predistortion of the signal sum due to quadrature sidebands on lead 21. Band-limiting circuits may be connected between lead 21 and load 22.

The output of difference circuit 27 is delivered over lead to signal-sum filter 29, which passes only substantially the frequency band of the signal sum. The output of filter 29 is delivered over lead 30 to negative-feedback equalizer 31, which equalizes phase shift over a wide frequency band, in accordance with negative-feedback theory.

The output of equalizer 31 is delivered over lead 32 to an input of signal-sum amplitude modulator 7, in a phase which causes amplitude modulator 7, amplifier 17, combiner 19, detectors 23 and 24, circuit 27, filter 29, and equalizer 31, to form a negative-feedback loop for the distortion generated on the signal sum in envelope detector 23. This loop is a configuration stabilized by negative feedback, which causes the in-phase signal-sum sidebands on lead 21 to be predistorted, so that when the wave on lead 21 is received by an envelope detector in a receiver, the distortion of the signal sum in the detector, caused by the presence of quadrature sidebands, is substantially cancelled by the predistortion of the in-phase sidebands, at the output of the envelope detector, as in the envelope detector in the transmitter.

Since many changes could be made in the above method, and many widely different embodiments could be made, without departing from the scope of the invention, it is intended that all matter in the above description and in the drawing shall be interpreted as illustrative only and not limiting.

We claim:

1. The method of generating a compatible AM stereo wave, which comprises:

receiving a first signal and a second signal and forming a first combination of said first and said second signals, and forming a second combination of said first and said second signals, wherein one of said combinations is the sum of said signals, and the other of said combinations is the difference of said signals, and generating a carrier of substantially constant amplitude and substantially constant frequency, and forming in-phase amplitude-modulation sidebands, of said first combination with predistortion, on said carrier suppressed, and forming quadrature amplitude-modulation sidebands of said second combination on said carrier shifted 90° and suppressed, and linearly combining said carrier, said in-phase sidebands, and said quadrature sidebands;

wherein the improvement comprises the predistorting of said first combination, so that said predistortion is substantially equal in amplitude, and substantially opposed in phase, to the distortion of said first combintion due to the presence of said quadrature sidebands, at the output of an envelope detector which receives said carrier, said in-phase sidebands and said quadrature sidebands, due to delivering said carrier, said distorted in-phase sidebands, and said quadrature sidebands, to an envelope detector, and to a synchronous detector, and obtaining the difference of the outputs of said said envelope detector and said synchronous detector by a difference circuit, and passing the output of said difference circuit through a filter with a pass-band substantially the same as the frequency band of said first combination of signals, and passing the output from said filter through an equalizer which adjusts the phase over a wide range of frequencies in accordance with negative-feedback theory, so as to prevent positive feedback around the negative-feedback loop which includes said filter and said equalizer, and adding the output of said equalizer to said first combination as said predistortion, and delivering said carrier, said in-phase sidebands generated by said predistorted first combination of said signals, and said quadrature sidebands generated by said second combination of said signals, to an RF load, as said compatible stereo wave.

* * * * *